US007661236B2

(12) United States Patent
Platt et al.

(10) Patent No.: US 7,661,236 B2
(45) Date of Patent: Feb. 16, 2010

(54) STAB-IN CONNECTOR WITH EXPANSION RELIEF

(75) Inventors: William J. Platt, Aston, PA (US); Daniel C. Ziegler, Millersville, PA (US); Yu Lin, Blue Bell, PA (US)

(73) Assignee: Worthington Armstrong Venture, Malvern, PA (US)

( * ) Notice: Subject to any disclaimer, the term of this patent is extended or adjusted under 35 U.S.C. 154(b) by 793 days.

(21) Appl. No.: 10/947,976

(22) Filed: Sep. 23, 2004

(65) Prior Publication Data

US 2005/0166523 A1 Aug. 4, 2005

Related U.S. Application Data

(63) Continuation-in-part of application No. 10/754,323, filed on Jan. 9, 2004.

(51) Int. Cl.

| | |
|---|---|
| ***E04B 9/08*** | (2006.01) |
| ***E04B 9/12*** | (2006.01) |
| ***E04B 9/18*** | (2006.01) |
| ***E04B 9/20*** | (2006.01) |

(52) U.S. Cl. ..... 52/506.06; 52/506.08; 52/506.07; 52/506.1

(58) Field of Classification Search ..... 52/506.01, 52/506.06, 506.05, 506.07, 664–667, 220.6, 52/573.1, 733.1, 581, 588.1, 606.1, 510, 52/506.03, 506.04; 403/347

See application file for complete search history.

(56) References Cited

U.S. PATENT DOCUMENTS

| | | | | |
|---|---|---|---|---|
| 3,193,063 | A | | 7/1965 | Brown et al. |
| 3,367,695 | A | | 2/1968 | Haertel et al. |
| 3,396,997 | A | | 8/1968 | Adams |
| 3,501,185 | A | | 3/1970 | Brown et al. |
| 3,746,379 | A | | 7/1973 | Sauer |
| 3,922,829 | A | | 12/1975 | Sauer |
| 4,106,878 | A | | 8/1978 | Jones |
| 4,108,563 | A | | 8/1978 | Brown et al. |
| 4,161,856 | A | | 7/1979 | Brown et al. |
| 4,317,641 | A | | 3/1982 | Sauer |
| 4,364,686 | A | | 12/1982 | Sharp et al. |
| 4,494,350 | A | | 1/1985 | Sharp |
| 4,499,697 | A | | 2/1985 | La Londe |
| 4,535,580 | A | | 8/1985 | Shirey |
| 4,549,383 | A | | 10/1985 | Vukmanic et al. |
| 4,601,153 | A | | 7/1986 | Dunn et al. |
| 4,611,453 | A | | 9/1986 | Worley |
| 4,621,474 | A | | 11/1986 | Worley |
| 4,648,230 | A | | 3/1987 | Mieyal et al. |
| 4,712,350 | A | | 12/1987 | Vukmanic |
| 4,715,161 | A | * | 12/1987 | Carraro et al. ..... 52/714 |
| 4,779,394 | A | | 10/1988 | Shirey et al. |
| 4,785,603 | A | | 11/1988 | Platt |
| 4,827,681 | A | | 5/1989 | Platt |
| 4,864,791 | A | | 9/1989 | Platt |
| 4,912,894 | A | | 4/1990 | Platt |
| 4,989,387 | A | | 2/1991 | Vukmanic et al. |

(Continued)

*Primary Examiner*—Jeanette Chapman
(74) *Attorney, Agent, or Firm*—Eugene Chovanes

(57) ABSTRACT

A V-shaped indent is formed in a stab-in connector for a suspended ceiling grid. The indent forms a vertical bend line.

In a fire, the connector bends along the vertical bend line to permit a cross beam in the grid to expand while keeping the grid intact, and thus capable of continuing to support the panels.

7 Claims, 10 Drawing Sheets

U.S. PATENT DOCUMENTS 5,044,138 A 9/1991 Zaccardelli et al.
5,216,865 A 6/1993 La Londe et al.
5,271,202 A 12/1993 Vukmanic et al.
5,517,796 A 5/1996 Koski et al.
5,699,641 A * 12/1997 Tinen et al. ..... 52/506.07
5,839,246 A * 11/1998 Ziegler et al. ..... 52/506.07
6,018,923 A * 2/2000 Wendt ..... 52/712
6,138,425 A * 10/2000 Wendt ..... 52/506.07
6,178,712 B1 1/2001 Sauer
6,199,343 B1 * 3/2001 Sauer et al. ..... 52/664
6,351,919 B1 * 3/2002 Lin et al. ..... 52/506.07
6,722,098 B2 * 4/2004 Platt ..... 52/733.1

* cited by examiner

STAB-IN CONNECTOR WITH EXPANSION RELIEF

This application is a continuation-in-part of U.S. patent application Ser. No. 10/754,323, filed Jan. 9, 2004 for STAB-IN CONNECTOR.

BACKGROUND OF THE INVENTION

1. Field of the Invention

Suspended ceilings having a metal grid framework that supports acoustical panels within rectangular enclosures formed by the grid are used extensively in commercial and industrial buildings.

In the event of a fire in an area covered by such a ceiling, it is of great benefit to keep such a ceiling relatively intact, so that the ceiling can act as a fire barrier to the supporting structure above the ceiling.

This invention relates to connectors in a grid for such ceiling that allow the beams in the grid to expand during a possible fire, in a controlled way, so that the ceiling stays relatively intact.

2. Prior Art

Suspended ceilings having metal main and cross beams interconnected into a grid that supports panels are well known. U.S. Pat. Nos. 5,839,246 and 6,178,712, for instance, incorporated herein by reference, show such ceilings.

The grid in such ceilings has, at each grid intersection, a pair of opposing cross beams and a main beam that form a connection. The connection is formed with connectors, generally in the form of clips, on the end of the cross beams that connect through, and with, a slot in the main beam.

Such a connection is shown in co-pending application Ser. No. 10/754,323 for STAB-IN CONNECTOR, filed Jan. 9, 2004, incorporated herein by reference.

Each cross beam in such a connection has a connector at its end that is thrust, or stabbed-in, from opposing sides of the main beam, through the slot in the main beam. The connectors are all identical.

The grid members of such a ceiling are subjected to high heat during a possible fire, creating expansion forces in the beam. If such expansion forces are not relieved in a controlled way, the beam distorts by buckling and twisting, and no longer supports the panel. The ceiling panel drops through the grid openings of the buckled grid, and the effectiveness of the suspended ceiling as a fire barrier is destroyed. The fire then attacks the building support structure. To avoid such a condition, the prior art has sought to relieve the expansion forces in a way that keeps the panels supported during a fire.

The main beams of a grid are generally kept relatively intact during a fire by providing cut-outs along the beam that permit the beam, in a controlled way, to collapse in-line, longitudinally, from the forces of compression created by the fire. Such an arrangement is disclosed, for instance, in U.S. Pat. No. 4,606,166.

In the cross beams, cut-outs are generally not used, since they weaken the beam unduly in these relatively short beams. Also, the relatively large controlled collapse is not necessary in the relatively short cross beams, since the expansion created by a fire is about 1/10 of an inch per foot, so that in a five foot cross beam, which is the maximum length generally used, approximately ½ inch relief is necessary.

One method of relieving the stress forces from a fire in cross beams is to design a connector on the end of the beam that pierces through the main beam, as seen in U.S. Pat. No. 5,839,246, incorporated herein by reference. The beam is thus permitted to expand, relieving forces due to the elevated temperature, and avoiding buckling of the beam.

Another method of relieving stress in a cross beam due to a fire, is to simply let the connectors at the end of the beam bend sidewise, at a bend line, so that, if they bend in the right direction, the beam moves diagonally, permitting the beam to expand in the diagonal direction before it abuts, at each end, the main beams. The length of the bend determines how much the beam can move in the desired direction, and how much the beam can expand. Such a result is shown, for instance, in FIGS. 4, 6, 7, and 13 of this application, the Figures being designated as prior art.

Generally such bend occurs in the prior art at the location where the connector is riveted to the beam through holes formed in the connector, one above another. Such a bend is shown in FIG. 21B of the '246 patent. These holes create a weak point in the connector, and the bend occurs at this weak point, at the end of the beam, causing the end of the beam to move along the main beam. The end of the connector remains in the slot. Such a bend often causes the cross beam to move too much from its original grid position, resulting in a beam displacement so large that it allows the panel to drop out. This is particularly true when the connectors bend in a direction at each end of the beam that translates the beam to a position parallel to its initial position, rather than diagonally wherein the beam still has a tendency to continue to support the panel.

A further problem in the prior art practice of simply allowing the connector to bend at the rivet holes which forms the weakest point in the connector, due to compression forces built up by a fire, is that there is no way of having the bend occur at a predetermined compression force. In some instances, the bend may occur at a force much less than at the optimum compression force of 100 pounds at which optimum relief occurs. At other times, the bend does not occur until a force of two or three hundred pounds is attained, by which time buckling of the cross beam begins to take place.

SUMMARY OF THE PRESENT INVENTION

The present invention is an improvement that is combined with the stab-in connector of the type in the '323 application. Such stab-in connector is improved so that it will bend in a desired direction in a controlled manner, at a specific location, under a predetermined force, to permit the beam to which it is attached to expand linearly without collapsing. With the improvement of the invention, the grid framework continues to retain the panel being supported by the beam, without permitting the panel to drop out, and thus expose the structural ceiling to the heat of the fire.

To achieve the above, a vertical bend line is created at a specific location in the connector forming the connection. The bend line is achieved with a V-shaped indent. The shape, depth, and position of the indent controls (1) the force necessary to bend the connector at the bend line, (2) the direction of the bend at the bend line, and (3) the location of the bend line where the bend occurs.

DESCRIPTION OF THE PREFERRED EMBODIMENT

Figure 1:
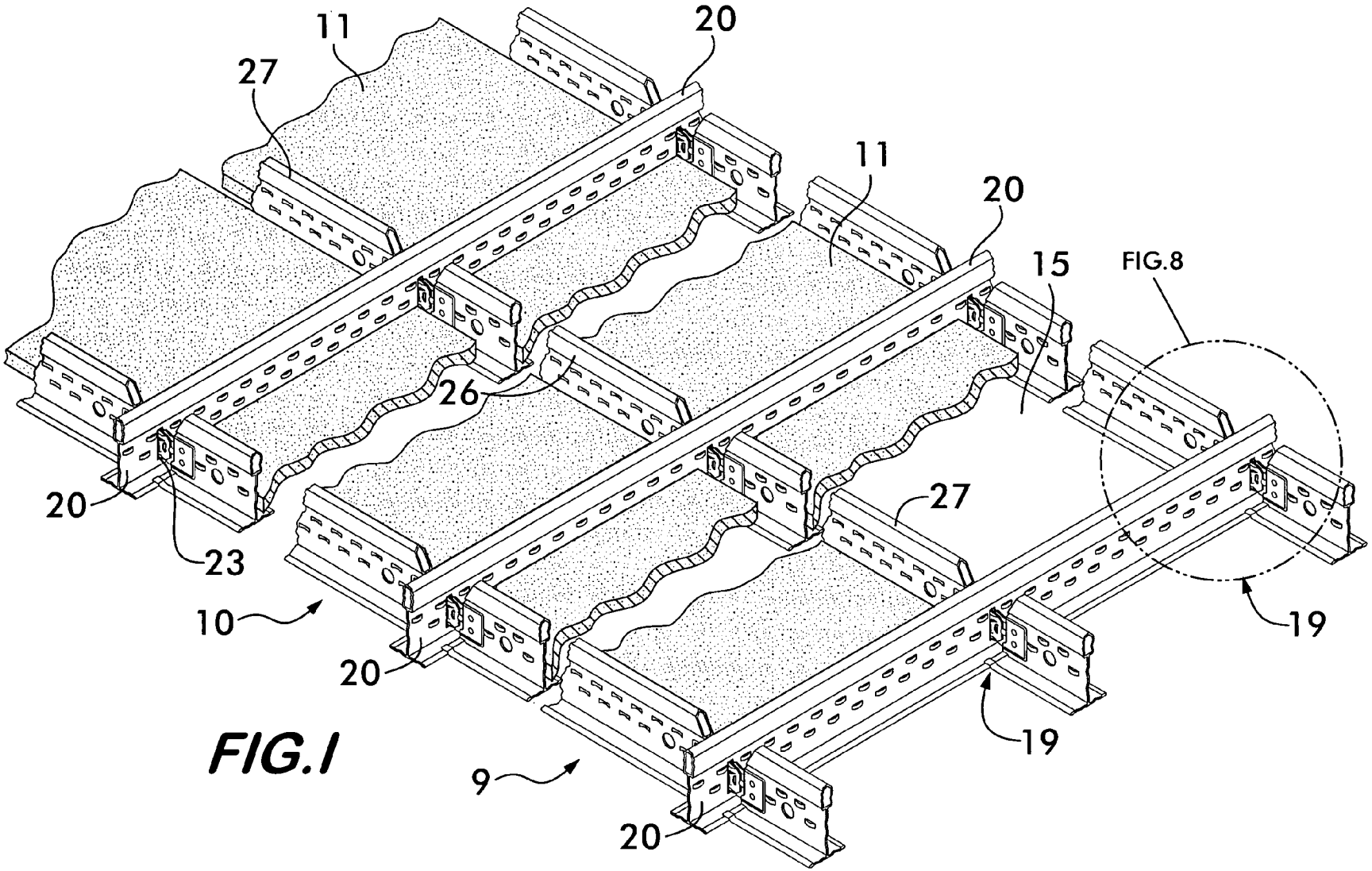
FIG. 1 is a perspective view, from above, of a section of a suspended ceiling having connections formed with the connectors of the invention.

The Connector Disclosed in the '323 Application

The present invention is an improvement in a connector of the type shown and disclosed in the U.S. patent application Ser. No. 10,754,323 filed Jan. 9, 2004 for Stab-In Connector. Such a '323 connector is shown in all the drawings of the present application which includes FIGS. 1 through 13. The connector is shown without the present improvement in FIGS. 4, 6, 7, 9C, and 13, and with the present improvement in the rest of the drawings. All the description and disclosure of the '323 application, including the drawings, is incorporated herein by reference, including that relative to the construction and use, is applicable to the connector of the invention.

The improvement of the present invention, as described later, becomes effective in the event of a fire.

In the present connection 19, main beam 20 extends longitudinally in a ceiling grid 10. Identical connectors 21 and 22 have been stabbed through a slot 23 in the web 25 of the main beam 20 and interconnect. The connectors 21 and 22 are connected respectively to cross beams 26 and 27 by rivets at 28.

At the top 43 of the connector 21 there extends a top outwardly disposed angled flange 65 approximately 30 degrees to the plane of the web 24 of the connector 21. This top angled flange 65 has a contoured edge 66.

At the bottom of the connector 21 there extends a bottom angled flange 72 having a contoured portion 73, with a stop 76. At the trailing edge of the connector 21 a contoured portion simply permits the connectors to be made in pairs with the trailing edge in common for each pair of connectors, after which the connectors are severed from one another.

In the connection 19, connectors 21 and 22 engage through slot 23 as shown in the drawings, and as explained in detail in the '323 application.

Stops 76 on bottom angled flange 72 of each of the connectors 21 and 22 abut against web 25 of main beam 20 and prevent further entry of either connector 21 or 22 into the slot.

To make the connection, a first connector, either connector 21 or 22, both being identical, with a leading edge 30, is thrust or stabbed through the slot 23 in the prior art manner, and then a second connector, either connector 21 or 22 is stabbed in the slot alongside the first connector.

Stitches 47 in the webs of main beams 20 and cross beams 26 and 27 strengthen the beams.

The Present Improvement Structure

Figure 9A:
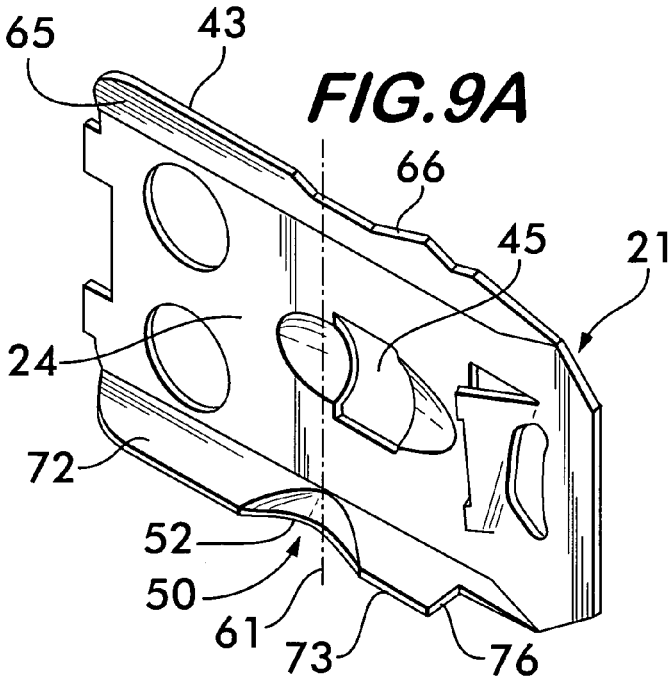
FIG. 9A is a perspective view of the connector of the invention.
Figure 9B:
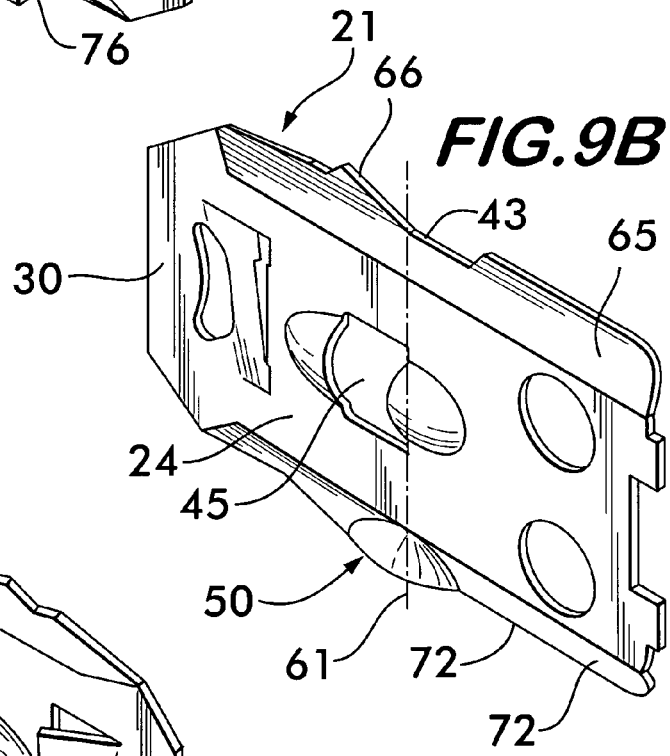
FIG. 9B is a perspective view of the connector of the invention shown in 9A, showing the opposite side of the connector.
Figure 9C:
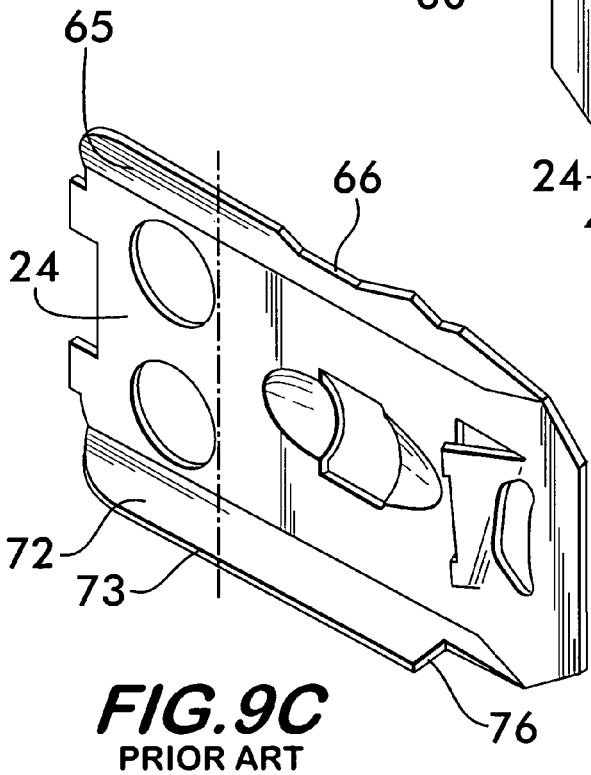
FIG.9C PRIOR ART
FIG. 9C is a view similar to 9A, showing the connector of FIGS. 9A and 9B without the present invention.

An indent 50, as seen particularly in FIGS. 9A and B, is formed in a connector at 51.

Figure 12:
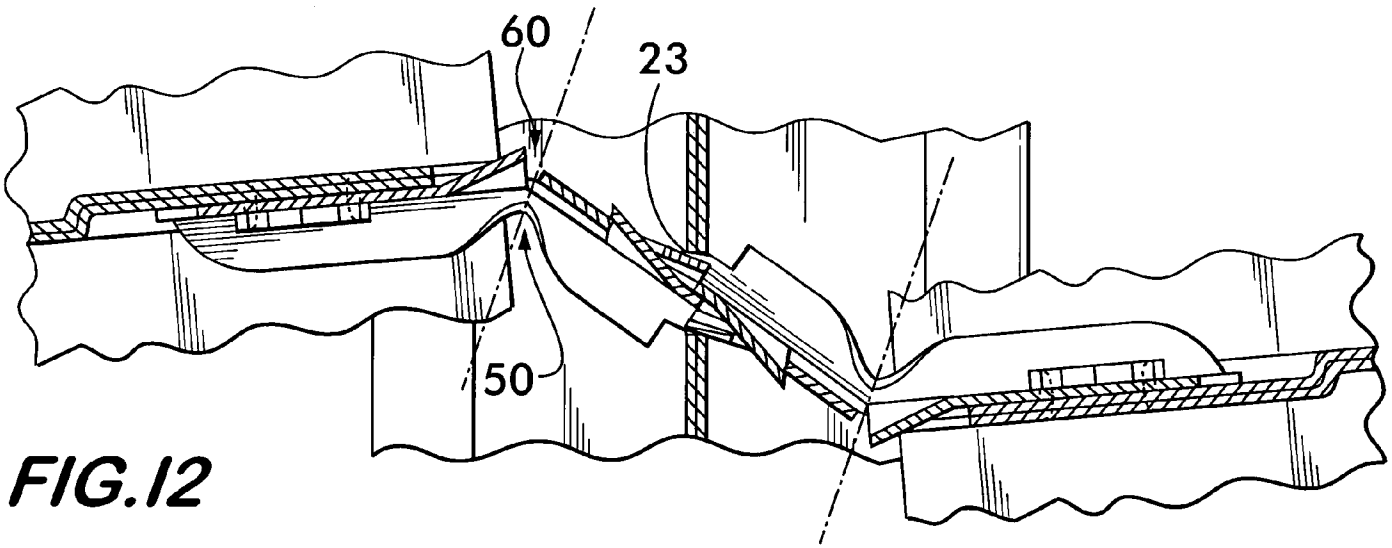
FIG. 12 is a top sectional view, similar to FIG. 11, taken from above, showing a connection having the connectors of the invention, after the cross beams have expanded during a fire.

The indent 50 is in V-shape, with a height 52 above the surface of the bottom angled flange 72 that has an effect on the bend. The greater the height 52 of the indent above the surface of the bottom angled flange 72, with a given V-shaped indent 50, the less force necessary to cause the connector 21 or 22 to bend, under a compression force, as shown in FIG. 12.

The location of the indent 50 determines at what point on the connectors 21 or 22 that a vertical bend line 61 is formed. The location of bend line 61 will determine where bend 60 will occur. In the embodiment shown in the drawings, the indent 50 is located immediately below the rearward side of a cutout 45 in the web 24 of the connector 21, so that bend line 59 passes vertically through the cutout 45. The cutout 45 renders the connector 21 less resistant to bending through the cutout 45 because of the absence of metal.

Figure 4:
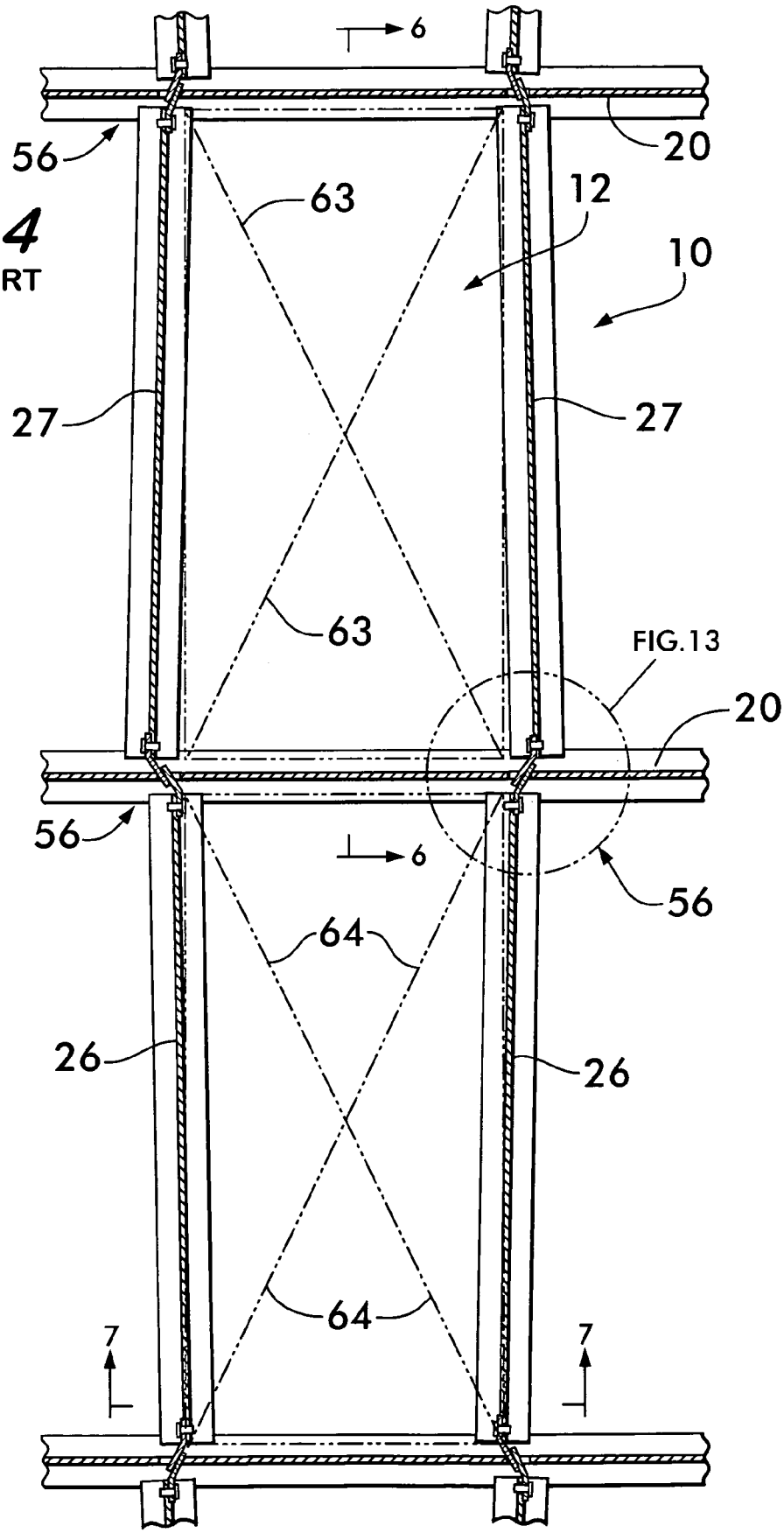
FIG.4 PRIOR ART
FIG. 4 is a top plan view, similar to FIG. 3, showing a suspended ceiling having connections formed with prior art connectors, after a fire.
Figure 6:
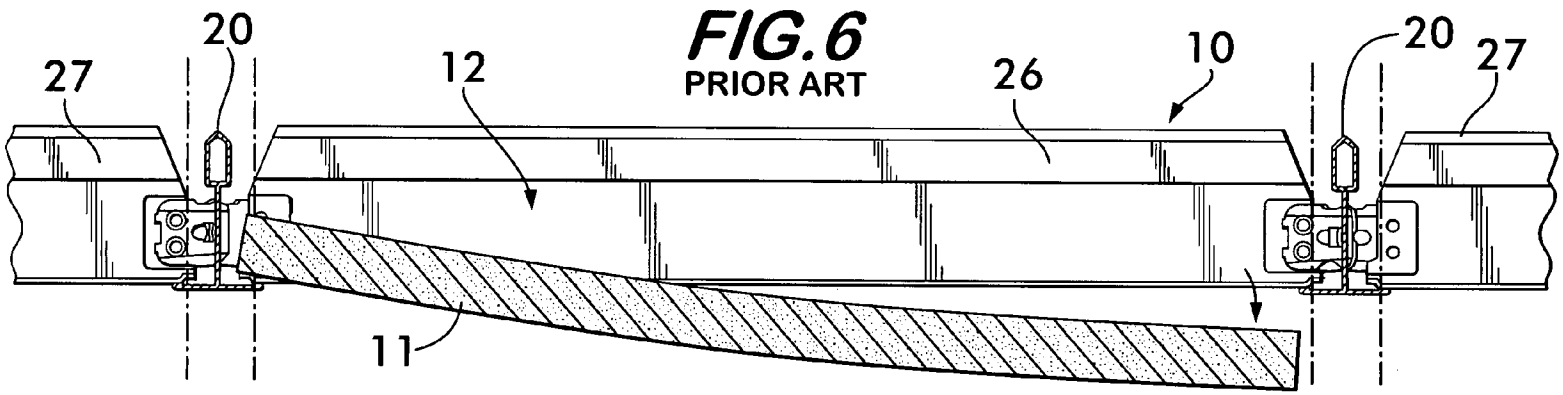
FIG.6 PRIOR ART
FIG. 6 is a section of a ceiling having connections formed with prior art connectors, taken on the line 6-6 in FIG. 4.
Figure 7:
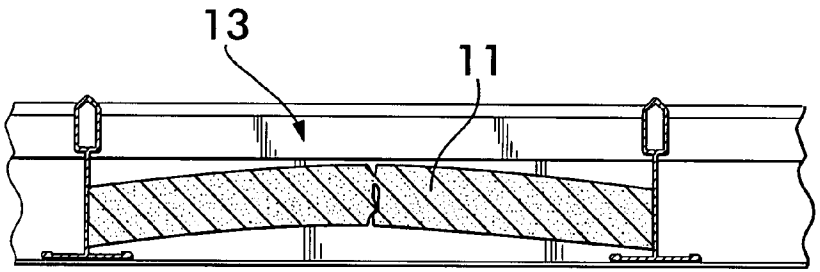
FIG.7 PRIOR ART
FIG. 7 is a section of a ceiling having connections formed with prior art connectors, after a fire, taken on line 7-7 in FIG. 4.
Figure 13:
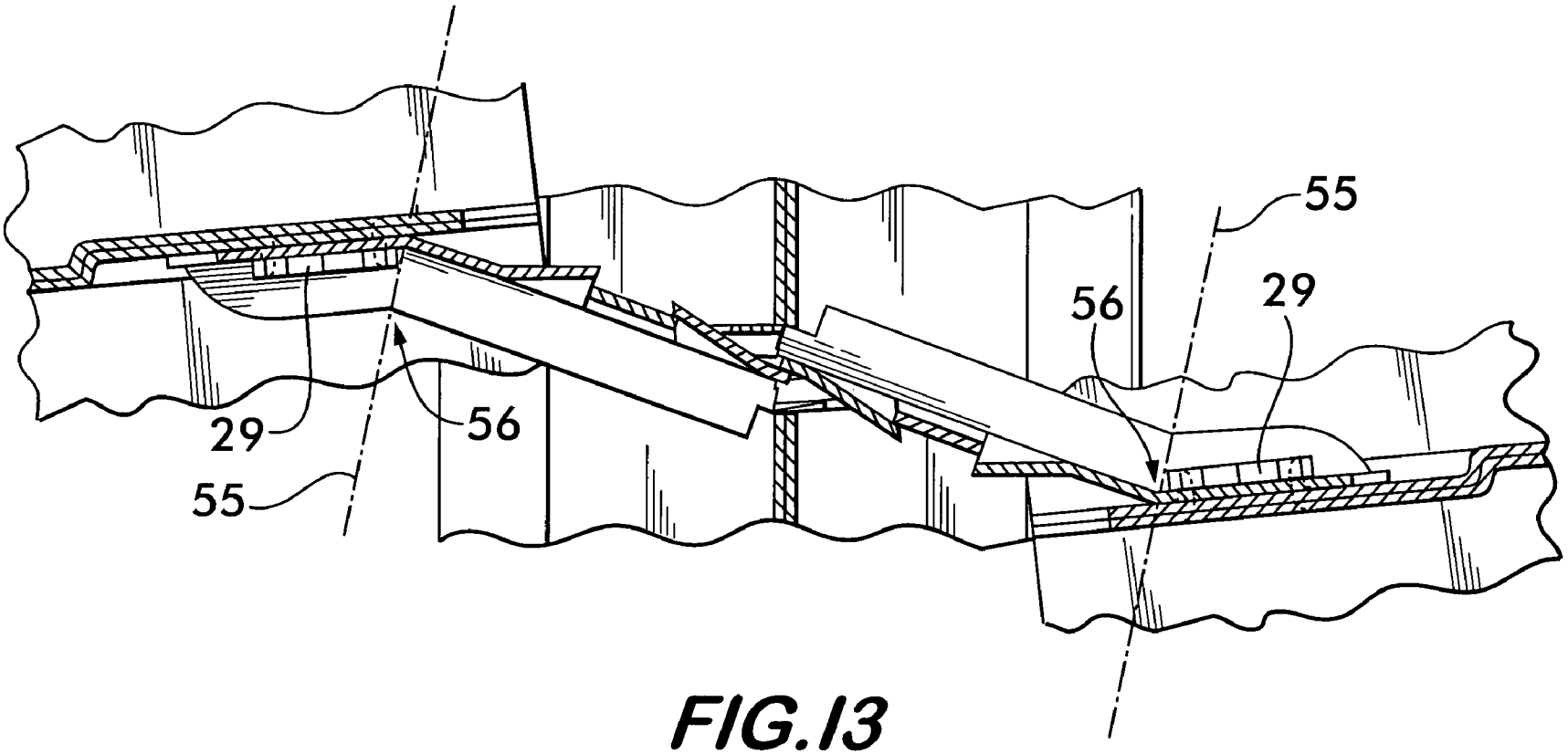
FIG.13 PRIOR ART
FIG. 13 is a top sectional view, similar to FIG. 12, showing a connection having prior art connectors, after the cross beams have expanded during a fire.

The bend 60 will always occur in the direction determined by the posture of the indent 50. As seen in FIG. 12, the bend 60 will occur in a direction as shown, with the posture of the indent 50 as shown. In effect, the bend 60 will occur in a direction that closes the V-shaped indent 50. In the prior art, as seen in particularly FIGS. 6 and 13, the prior art bend 56 occurred along a prior art bend line 55 which was immediately in front of the rivet holes 29, since it is along such bend line 55 wherein there is the least metal to resist such a bend. As explained above, such prior art bend 56 generally was unsatisfactory since it created too long a bend, that displaced the cross beam too great an amount. Additionally, in the prior art, the direction of the prior art bend 55 of the connector 21 was not consistent. The prior art bend 55 sometimes occurred clockwise with respect to the cross beam 26 to which it was attached, when viewed from above, as shown in FIG. 13. At other times, the prior art bend 55 occurred in a counterclockwise direction. Such inconsistent prior art bends 55 often resulted in an enlarged opening 12 in the grid 10 as shown in FIGS. 4 and 6, wherein panel 11 dropped out of the enlarged opening 12. Alternatively, an opening 13 could be reduced as shown in FIGS. 4 and 7 where the panels 11 are compressed and broken so they fall out of the reduced opening 13.

Figure 3:
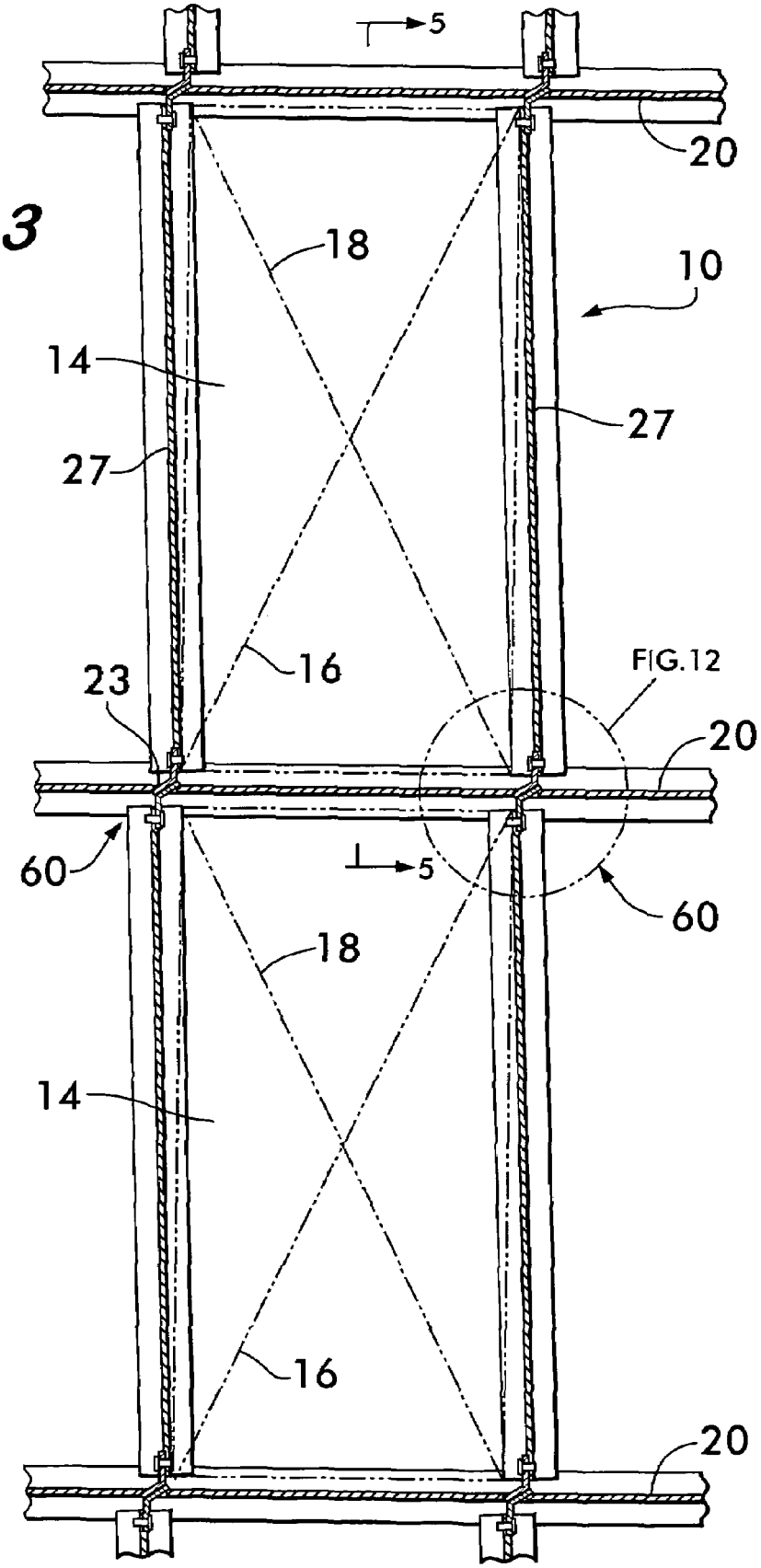
FIG. 3 is a partial top plan view of the ceiling shown in FIG. 2, after a fire.
Figure 5:
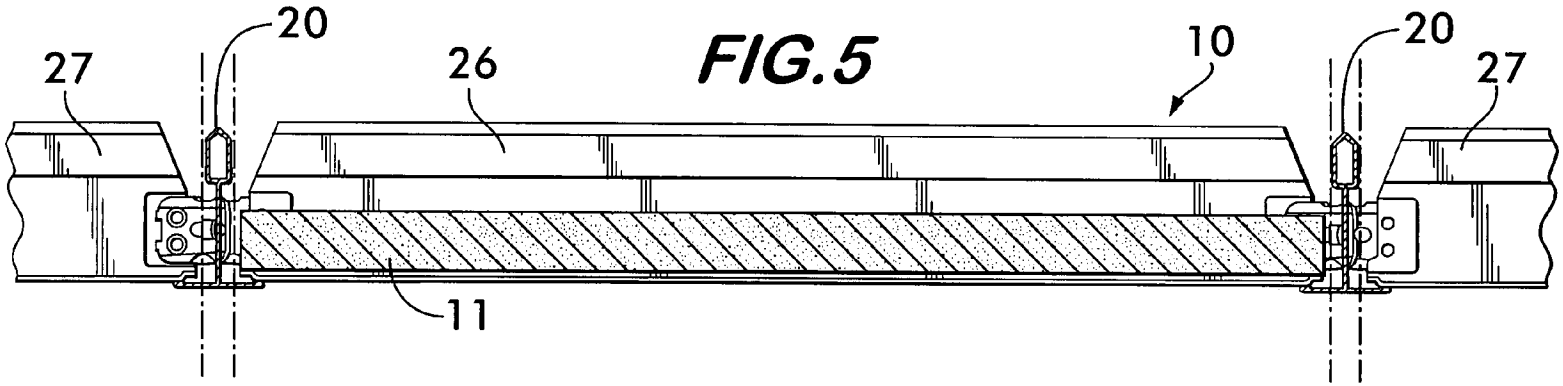
FIG. 5 is a section of a ceiling taken on the line 5-5 in FIG. 3.

Additionally, by limiting the length of the bend 60 of the connector 21 to less than the length of the prior art bend 56 which occurred at the rivet holes 29, as shown in FIGS. 4 and 6, the deviation of the end of the cross beams 26 and 27 during a fire from its position in a rectangular grid 10 before a fire, will be less. For example, a bend 60 in the connector 21 or 22, where the indent 50 is located ¼ inch from the stop 76 of a connector, which abuts against a web 24 of the web of a connector 21 or 22, will create enough room for a cross beam to expand up to ¼ inch at each end for a total of M inch at both ends, which is adequate expansion for up to a five foot cross beam 26, 27 during a fire. Such a sideways controlled direction bend, will still be adequate to retain the panel in a grid opening, as seen in FIGS. 3 and 5, since the controlled direction of the bend 60, as well as the controlled length of the bend 60, will create a parallelogram 14 of the grid 10, as seen in FIG. 3 from the rectangular layout of the grid 10 previous to the fire, as seen in FIG. 12.

Figure 2:
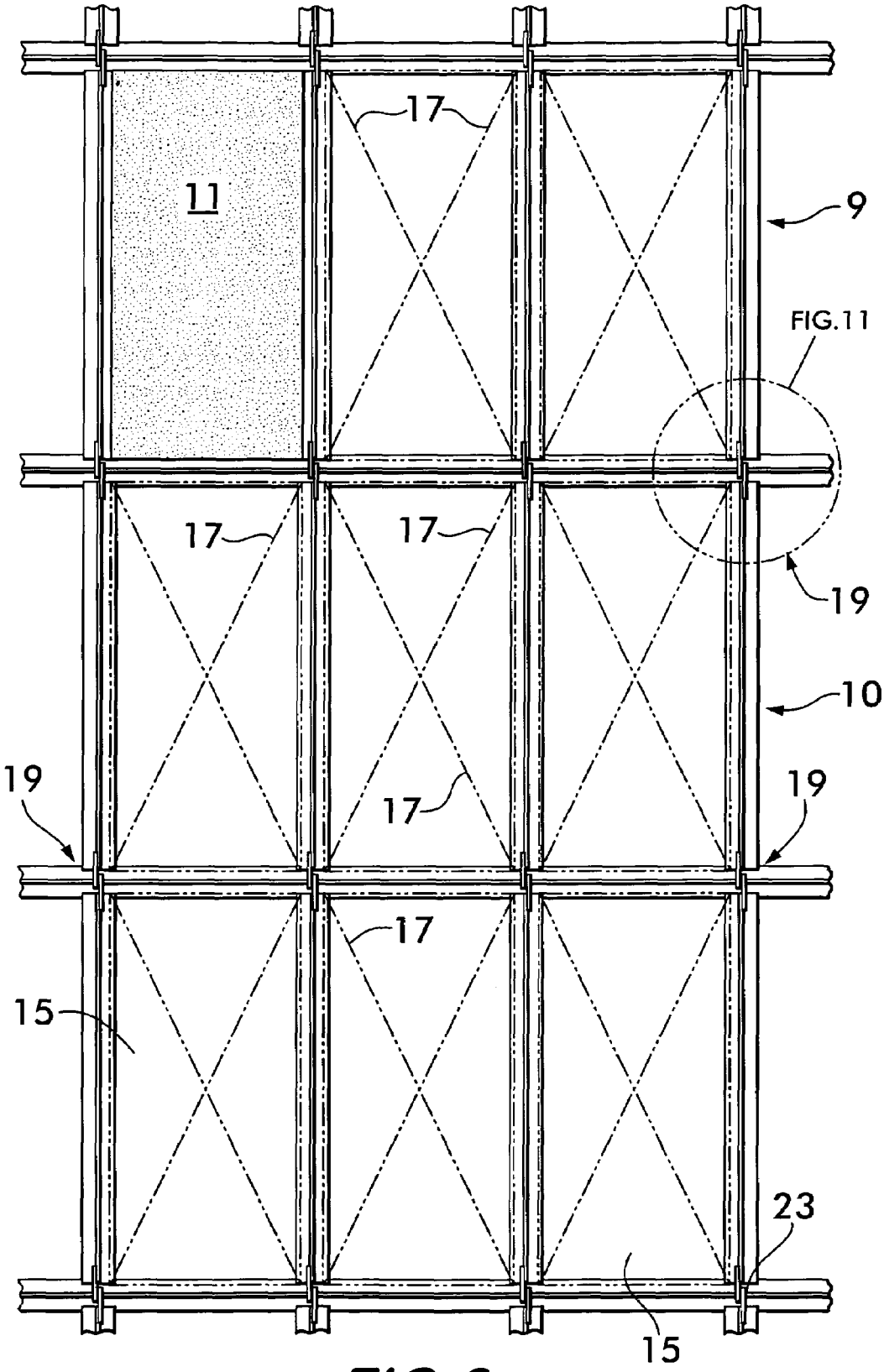
FIG. 2 is a top plan view of a suspended ceiling having connections formed with the connectors of the invention, before a fire.

In the rectangular grid 10, as seen in FIG. 2, the equal length diagonal lines 17 represent the equal distance from opposing corners in a rectangular opening. In the parallelogram 14 of FIG. 3, one of the diagonals 16 is slightly shortened and one diagonal 18 is slightly lengthened, so that a grid opening continues to be capable of supporting the panel 11. As seen in FIG. 4, the diagonals in a prior art opening that sometime occurred, are either both lengthened as at 63, or both shortened as at 64, resulting in an enlarged opening or reduced opening no longer capable of supporting the panels 11.

The parallelogram 14 is still adequate to retain the panel 11 in a grid opening 15, since a panel 11 is generally slightly smaller than that formed by the webs 25 of the grid 10 defining an opening. Thus, in the parallelogram 14, the main beams 20 continue to extend parallel to one another at a four foot spacing, since the expansion of a main beam 20 is accommodated by cut-outs, as explained above.

The slight shift into a parallelogram 14 that occurs with the controlled bends 60 of the connector of the invention does not destroy the continued support of the panel 11 by the flanges of the cross beams 26, 27, and there is no undue interference by the webs of the cross beams against the panel 11 edges.

By limiting the bend 60 of the connector 21, 22 of the invention to less than the prior art bend which occurred at the rivet point 29 in a prior art connector, as occurred in the prior art as shown in FIGS. 4, 6, and 7, the deviation of the cross beam 26, 27 from a rectangular grid 10 will be less.

Still another advantage of the present invention is that the compressive force at which the connector 21, 22 bends can be controlled. The deeper the V-shaped indent into the bottom angled flange 72, which results in a greater height of the indent 50 above bottom flange 73, the less the force that is necessary to bend the connector 21, 22. The actual depth can readily be determined through slight experimentation, since the thickness and composition of the metal from which the connector is formed is a factor that must be considered in establishing the depth of the indent. It is desirable to have the connector bend at a bend line 80 on the indent at about a force of 100 pounds.

Operation

Figure 8:
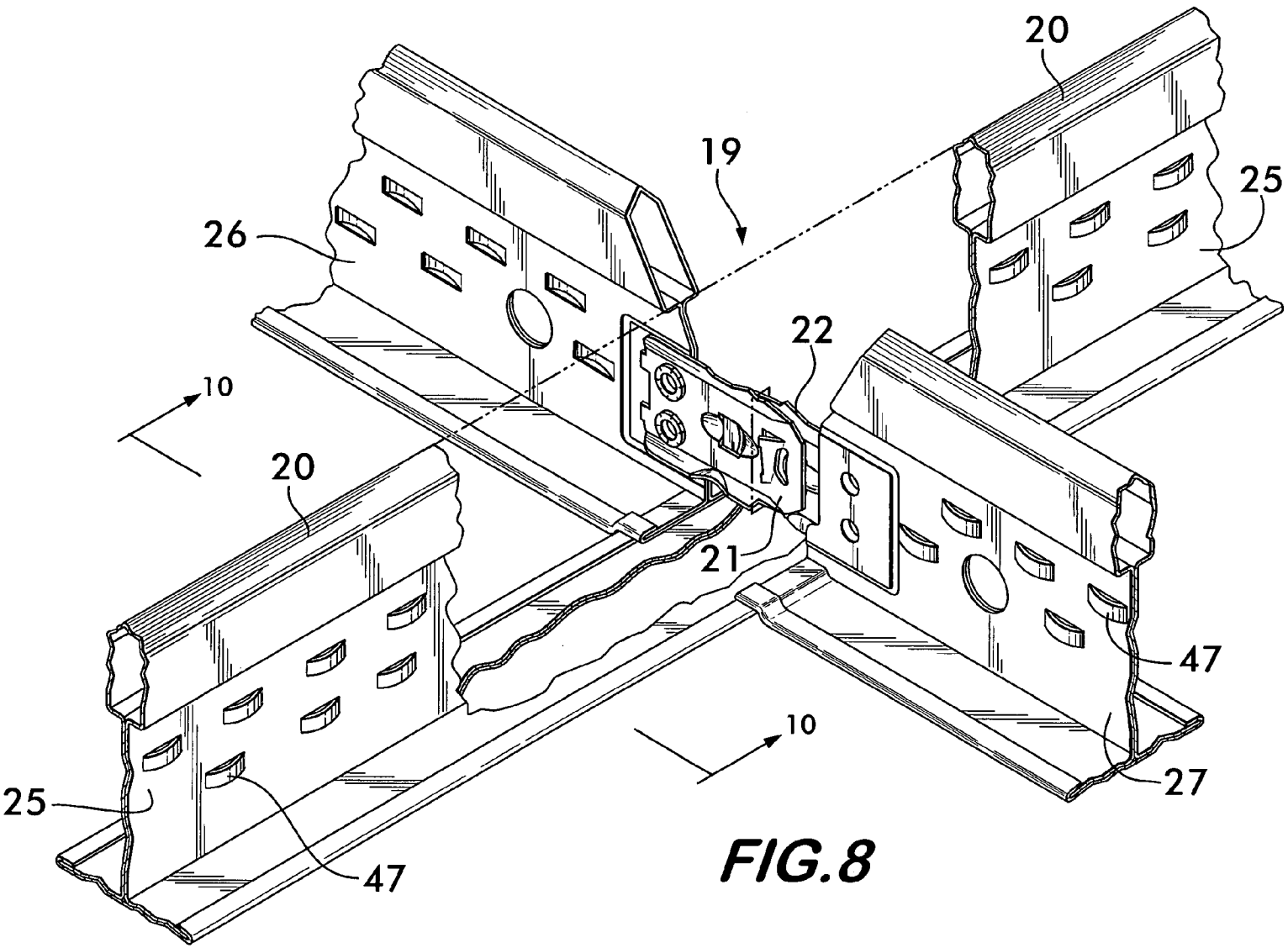
FIG. 8 is a perspective view of a connection having connectors of the invention, with the main beam partially broken away.
Figure 10:
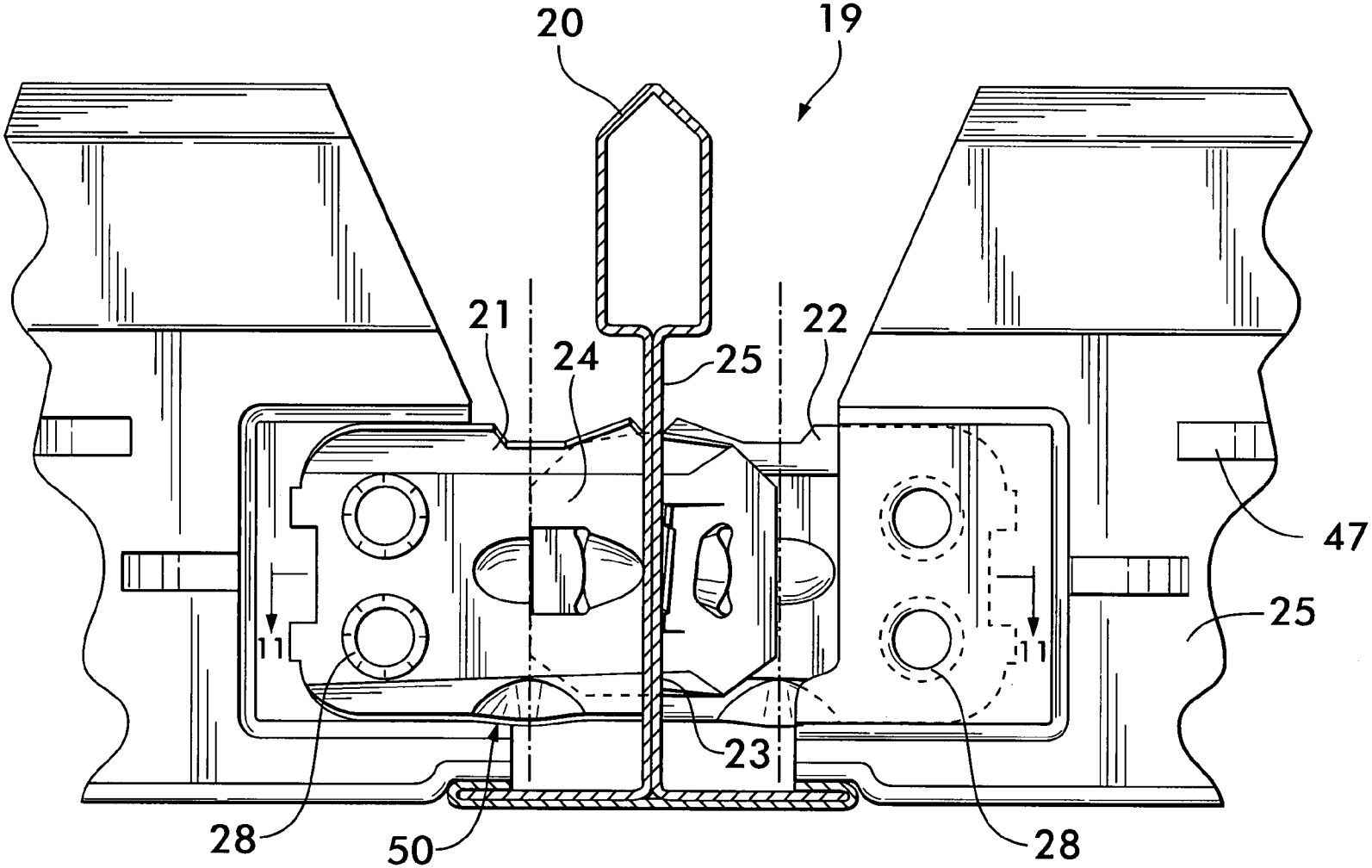
FIG. 10 is a side view of a connection, showing the connectors of the invention connected together through a slot in a main beam, which is shown in section.
Figure 11:
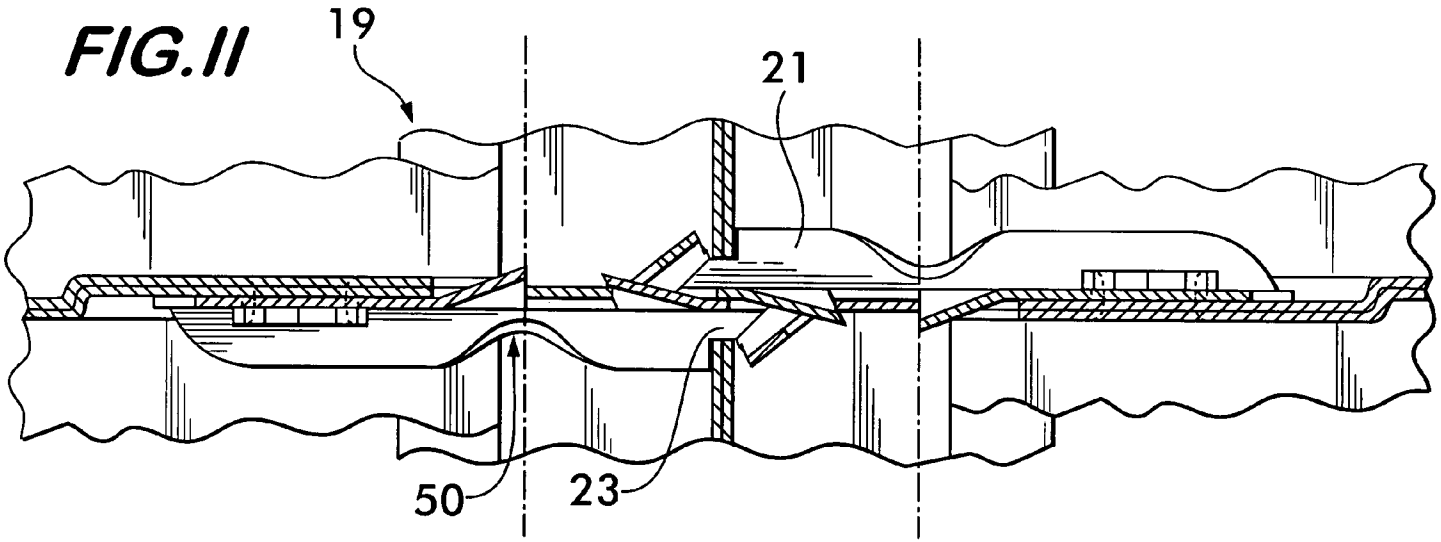
FIG. 11 is a sectional view, taken from above, showing a connection, with the connectors of the invention.

A suspended ceiling 9 having connections 19 of the invention, is shown under normal circumstances in FIGS. 1 and 2, wherein cross beams 26 and 27 and main beams 20 form a grid 10. The grid 10 has rectangular openings 15 that support panels 11 on flanges of the grid beams. The beams are connected through the connections 19 as also shown in FIGS. 8 and 10. The connection 19 of FIGS. 8 and 10 is that shown in the '323 application with the improvement of the present invention.

As seen in FIG. 2, the grid openings 15 form rectangles having equal diagonal lengths 17, wherein the connections 19 at the intersection of the beams form right angles of the main and cross beams. The rectangular panels 11 are supported in the rectangular openings 15 created by such right angle connections.

In the event of a fire, expansion forces are built up in the main beams 20 and the cross beams 26 and 27 from the heat of the fire, and unless these forces are relieved, the beams will buckle, allowing the panels 11 to drop out of the grid 10, and permitting the heat of the fire to attack the structural ceiling.

In the grid 10 using the connections 19 of the invention, the cutouts in the main beams 20 permit the main beams 20 to expand by folding longitudinally at the cutouts, so that the main beams 20 remain parallel to each other in the grid 10.

The cross beams 26 and 27 are permitted to expand by the connectors 21 and 22 bending at the V-shaped indents 50 in a direction as seen particularly in FIGS. 3 and 12. This controlled expansion of the cross beams 26 and 27, results in a slight parallelogram 14 as seen in FIG. 3, which continues to support the panels, as seen in FIG. 5. The connectors 21 and 22 bend 60 in a controlled direction at a predetermined force at a predetermined bend line 61, so that the ceiling remains intact during a fire.

In the prior art, a ceiling 9, as seen from below in FIG. 4, that has been exposed to a fire, has connectors that have been bent from expansion forces, as seen in FIG. 13. The bends 56 which occur along bend lines 55 at the rivet holes 29, which are the weakest part of the connector. The bends can occur in different directions, which in turn create expanded rectangular openings, seen in the upper part of FIG. 4, or reduced rectangular openings, as seen in the lower part of FIG. 4, causing the panel to crumble, as seen in FIG. 7, and drop out of the opening. The prior art bends 56 may require such a great force so that the cross beam buckles before the bend 56 occurs, or the bend 56 may occur at such a low force that the required stiffness to have the grid continue to support the panels does not exist.

In the present invention, the connectors 21 and 22, with indents 50, as set forth above, create bend lines 61 that create bends 60 in the event of a fire that form parallelograms of the grid openings that continue to support the panels 11 to keep the ceiling intact. Such an intact ceiling protects the structural ceiling from the heat of the fire.

What is claimed is:

1. In a stab-in connector for a cross beam in a grid of a suspended ceiling, wherein the grid supports panels in rectangular grid openings;

the connector having a top and a bottom angled flange extending outwardly at its top and at its bottom, respectively, the improvement comprising the connector with an indent, wherein the indent is formed v-shaped in the bottom angled flange with a height above the surface of the bottom angled flange.

2. The improvement of claim 1 wherein the depth of the indent controls the force at which a bend occurs, along the bend line, from expansion forces created by a fire.

3. The improvement of claim 1 wherein the indent controls the direction in which the bend occurs.

4. The improvement of claim 1 wherein the bend, during a fire, permits grid openings in the grid to change from a rectangular shape to a parallelogram shape, wherein, in such change, opposing main beams remain stationary and opposing cross beams shift to a diagonal position, whereby the panels continue to be supported in the grid openings.

5. The improvement of claim 1 wherein the connectors bend at a force of about 100 pounds.

6. The improvement of claim 1 wherein the cross beams and main beams have stitching in their webs to strengthen the beams.

7. The improvement of claim 1 wherein the indent is located vertically in line with a hole in the connector.

* * * * *